US007027610B1

(12) United States Patent
Kihara

(10) Patent No.: US 7,027,610 B1
(45) Date of Patent: Apr. 11, 2006

(54) LOUDSPEAKER

(75) Inventor: Takaei Kihara, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 853 days.

(21) Appl. No.: 09/613,389

(22) Filed: Jul. 11, 2000

(30) Foreign Application Priority Data

Jul. 27, 1999 (JP) ..... 11-211684

(51) Int. Cl.
*H04R 1/00* (2006.01)

(52) U.S. Cl. ..... 381/430; 381/190

(58) Field of Classification Search ..... 381/423, 381/190, 340, 114, 173, 191, 430
See application file for complete search history.

(56) References Cited

U.S. PATENT DOCUMENTS 4,344,503 A * 8/1982 Nakamura et al. ..... 181/170
4,437,541 A * 3/1984 Cross ..... 181/151
5,802,196 A * 9/1998 Nakamura ..... 381/423
6,243,475 B1 * 6/2001 Nakamura et al. ..... 381/190
6,356,642 B1 * 3/2002 Nakamura et al. ..... 381/342
6,502,662 B1 * 1/2003 Nakamura et al. ..... 181/152
6,590,992 B1 * 7/2003 Nakamura ..... 381/430

FOREIGN PATENT DOCUMENTS

JP 50-110647 2/1974

* cited by examiner

*Primary Examiner*—Brian T. Pendleton
(74) *Attorney, Agent, or Firm*—Keating & Bennett, LLP

(57) ABSTRACT

A loudspeaker contains a hemispherical vibrator. The end portion of the hemispherical vibrator on the side opposite to the hemispherical curved surface is mounted on the main surface of a first circular baffle board. On the opposite side of the first baffle board from the side where the vibrator is mounted, a second baffle board is arranged so as to be approximately parallel with the first baffle board. The first baffle board and second baffle board are connected by four spacers with a space between them.

21 Claims, 3 Drawing Sheets

LOUDSPEAKER

BACKGROUND OF THE INVENTION

1. Field of the Invention

The present invention relates to a loudspeaker and more particularly to a high-frequency loudspeaker using a spherical or hemispherical vibrator.

2. Description of the Related Art

FIG. 5 is a partially cutaway perspective illustration of one example of conventional loudspeakers. A loudspeaker 1 using a spherical or hemispherical vibrator has been proposed as a nondirectional high-frequency loudspeaker. The spherical or hemispherical vibrator 2 is composed of a vibrating object 3 made up of a spherical or hemispherical piezoelectric material on the internal and external surfaces of which electrodes 4 and 4 are provided as shown in FIG. 5 and is driven by a driving mechanism 5, such as an amplifier, connected to the electrodes 4 and 4.

However, the conventional loudspeaker 1 exhibited an uneven sound pressure characteristic as shown in FIG. 6 because the sound pressure is intensified at the natural resonant frequency $F_0$ of the resonator 2, and diminished at other frequencies.

SUMMARY OF THE INVENTION

To overcome the problems described above, preferred embodiments of the present invention provide a loudspeaker using a spherical or hemispherical vibrator which has an exceptional and flat sound pressure characteristic.

A loudspeaker according to preferred embodiments of the present invention includes a spherical or hemispherical vibrator, a first baffle board on which the vibrator is mounted, a second baffle board arranged with a space between the first and second baffle board, and spacers which connect the first and second baffle boards.

In a loudspeaker according to preferred embodiments of the present invention, the vibrator is configured so that it has a natural resonant frequency higher than the desired bandwidth of the loudspeaker.

Further, in a loudspeaker according to preferred embodiments of the present invention, the baffle boards are configured so that they have the natural resonant frequencies which is lower than that of the vibrator.

Further, in a loudspeaker according to the preferred embodiments of the present invention, the first and second baffle board are desirable to have the natural resonant frequencies which are different from each other.

Further, in a loudspeaker according to preferred embodiments of the present invention, the natural resonant frequency of the space is set at a frequency which is different from the natural resonant frequency of the vibrator and the resonant frequencies of the baffle boards.

The sound pressure characteristic of a loudspeaker is improved by mounting a spherical or hemispherical vibrator on a baffle board. However, because there is a frequency at which the sound wave coming from the front side of the baffle board and the sound wave from the back side offset each other, in a single baffle board the sound pressure characteristic is irregular and accordingly the improvement of the sound pressure characteristic is insufficient. In this invention, by giving a plurality of baffle boards and producing a plurality of peaks in the sound pressure characteristic, the sound pressure characteristic is flattened, thus substantially improving the sound pressure characteristic.

Other features, elements, characteristics and advantages of the present invention will become more apparent from the following detailed description of preferred embodiments and with reference to the attached drawings.

DESCRIPTION OF THE PREFERRED EMBODIMENT

Figure 1:
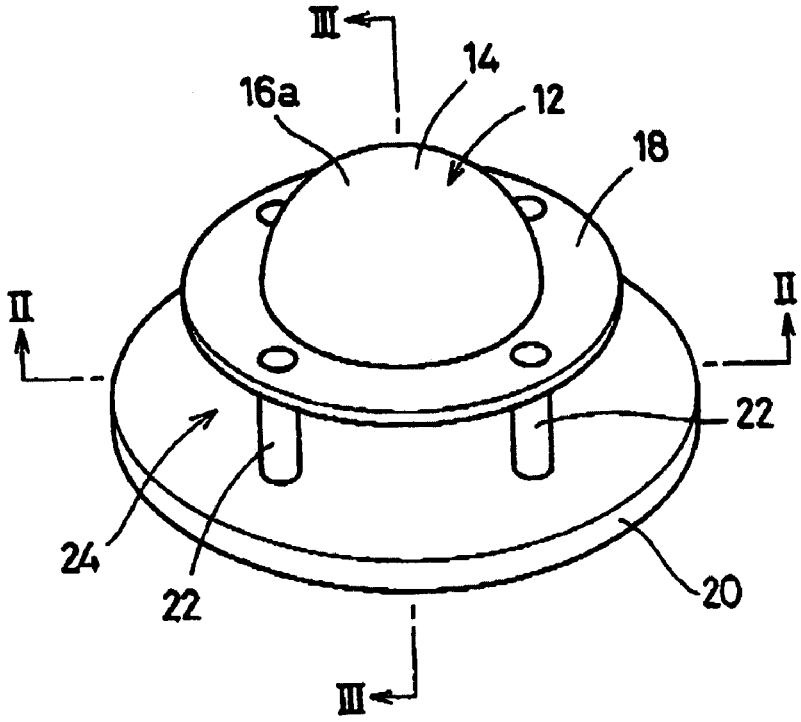
FIG. 1 is a perspective view showing one preferred embodiment of a loudspeaker according to the present invention.
Figure 2:
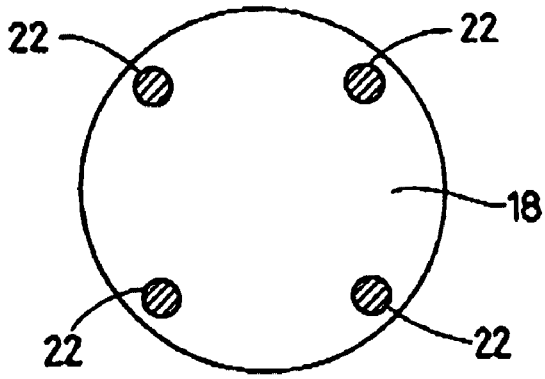
FIG. 2 is a sectional view taken on line II—II of FIG. 1.
Figure 3:
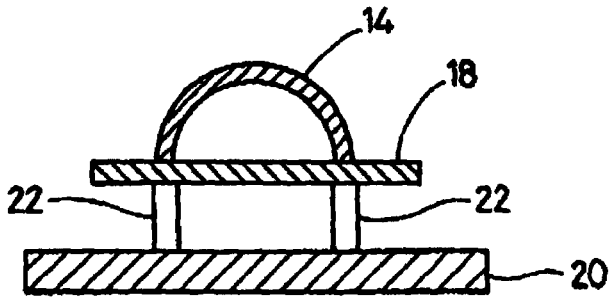
FIG. 3 is a sectional view taken on line III—III of FIG. 1.

FIG. 1 is a perspective view of one preferred embodiment of a loudspeaker according to the present invention.

The loudspeaker 10 includes a hemispherical vibrator 12 to convert an electrical signal into mechanical vibration. The vibrator 12 includes a hemispheric vibrating object 14 made of a piezoelectric material of, for example, ceramics, or other suitable piezoelectric material. On the curved internal and external surfaces of the vibrating objects 14, electrodes **16*a* and 16*b* are provided as a driving mechanism for driving the vibrating object 14. The vibrating object 14 is polarized in the thickness direction from the internal surface to the external surface. Further, the vibrator 12 is configured to have the natural resonant frequency higher than the desired bandwidth of the loudspeaker 10**.

As for the vibrator 12, the end surface on the opposite side of the hemispherical curved surface is mounted on the main surface of a first baffle board 18. An adhesive is used for mounting to vibrator 12 to the first baffle board 18.

On the side of the first baffle board 18 opposite from the side where the vibrator 12 is mounted, a second baffle board 20 is arranged to be approximately in parallel with the first baffle board 18. In this loudspeaker 10, the second baffle board 20 has a diameter which is greater than that of the first baffle board 18. These baffle boards 18 and 20 are made of materials such as resin, wood, metal, or other suitable material. Further, the natural resonant frequency Fa of the first baffle board 18 and the natural resonant frequency Fb of the second baffle board 20 are set to be lower than the natural resonant frequency $F_0$ of the vibrator 12, and, furthermore, the natural resonant frequency Fa of the first baffle board 18 and the natural resonant frequency Fb of the second baffle board 20 are set to be different from each other.

The first baffle board 18 and second baffle board 20 are connected by, for example, four spacers 22. By adjustment of the length of the spacers 22, the volume of a space 24 between the first baffle board 18 and the second baffle board 20 is adjusted, and in this way the resonance frequency Fc of the space 24 can be adjusted to any desired value. In the loudspeaker 10 of the present embodiment, the resonance frequency Fc of the space 24 is set at an intermediate value between the natural resonant frequency Fa of the first baffle board 18 and the natural resonant frequency Fb of the second baffle board 20.

Figure 4:
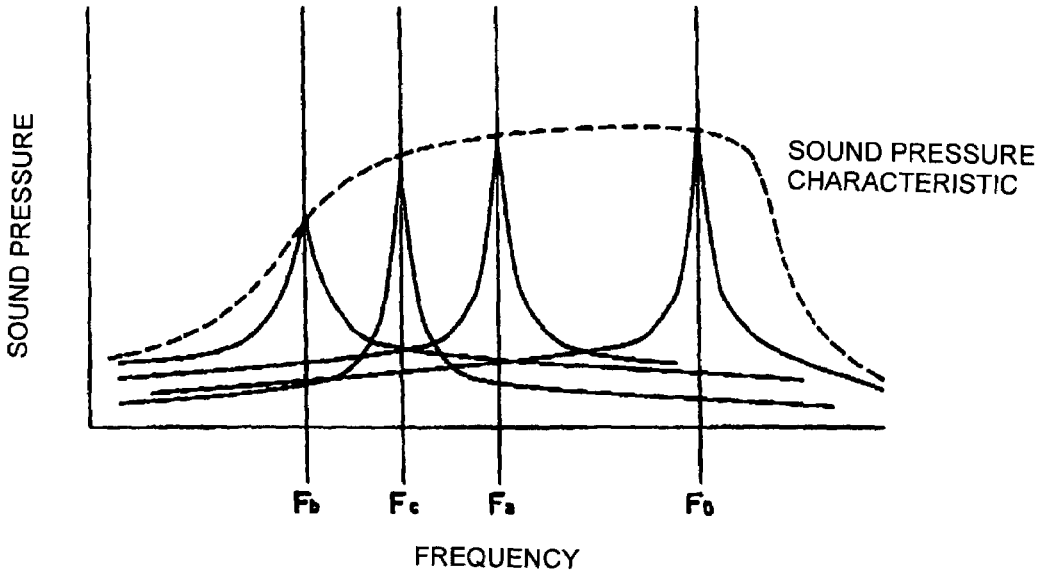
FIG. 4 shows the sound pressure characteristic of the loudspeaker shown in FIG. 1.
Figure 5:
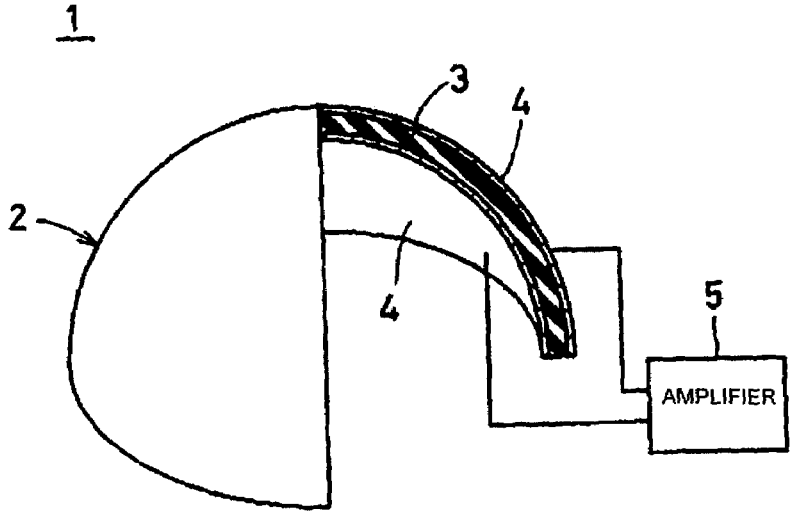
FIG. 5 PRIOR ART
FIG. 5 is a partially cutaway perspective illustration of one example of conventional loudspeakers.
Figure 6:
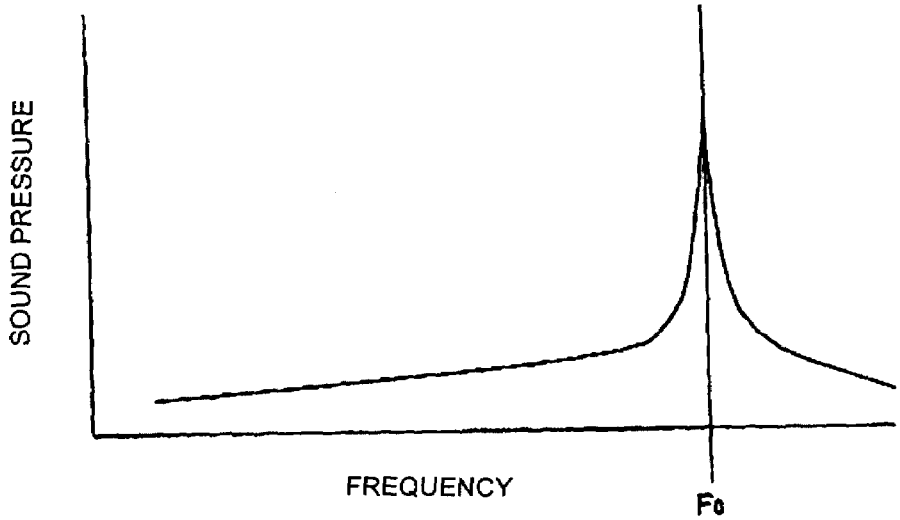
FIG.6 PRIOR ART
FIG. 6 shows the sound pressure characteristic of the conventional loudspeaker shown in FIG. 5.

In the loudspeaker 10, the vibrator 12 is mounted on the first baffle board 18, the first baffle board 18 and the second baffle board 20 are connected by the spacers 22 with the space 24 between them, and, furthermore, the natural resonant frequency of each of the vibrator 12, the first baffle board 18, and the second baffle board 20, and the resonance frequency of the space 24 are different from one another. Accordingly, as shown by a broken line in FIG. 4, a plurality of peaks are produced in the sound pressure characteristic over a wide frequency band and the sound pressure characteristic is effectively flattened. Therefore, the sound pressure characteristic of the loudspeaker 10 is greatly improved.

According to the present invention, with the flat sound pressure characteristic over a wide frequency band, the sound pressure characteristic is greatly improved and as a result a loudspeaker showing a sufficient sound pressure characteristic in the set bandwidth is achieved.

It should be understood that the foregoing description is only illustrative of the present invention. Various alternatives and modifications can be devised by those skilled in the art without departing from the invention. Accordingly, the present invention is intended to embrace all such alternatives, modifications and variations which fall within the scope of the appended claims.

What is claimed is:

1. A loudspeaker having a desired bandwidth comprising:

a spherical or hemispherical vibrator having a natural resonant frequency;

a first baffle board to mount the vibrator;

a second baffle board arranged with a space between the second baffle board and first baffle board; and a plurality of spacers for connecting the first baffle board and second baffle board;

wherein the natural resonant frequency of the vibrator has a value that is greater than any frequency in the desired bandwidth of the loudspeaker.

2. A loudspeaker as claimed in claim 1, wherein the first and second baffle boards have natural resonant frequencies which are lower than the natural resonant frequency of the vibrator.

3. A loudspeaker as claimed in claim 1, wherein the first baffle board and second baffle board have the natural resonant frequencies which are different from each other.

4. A loudspeaker as claimed in claim 3, wherein the first and second baffle boards have natural resonant frequencies which are lower than the natural resonant frequency of the vibrator.

5. A loudspeaker as claimed in claim 1, wherein the resonance frequency of the space is different from the natural resonant frequency of the vibrator, and different from the natural resonant frequencies of the baffle boards.

6. A loudspeaker as claimed in claim 1, wherein the resonance frequency of the space is lower than the natural resonant frequency of the vibrator.

7. A loudspeaker as claimed in claim 5, wherein the resonance frequency of the space is lower than the natural resonant frequency of the vibrator.

8. A loudspeaker as claimed in claim 1, wherein the resonance frequency of the space is higher than one of said first and second baffle boards, and lower than the other of said first and second baffle board.

9. A loudspeaker as claimed in claim 5, wherein the resonance frequency of the space is higher than one of said first and second baffle boards, and lower than the other of said first and second baffle board.

10. A loudspeaker as claimed in claim 1, wherein said plurality of spacers includes four spacers.

11. A loudspeaker as claimed in claim 1, wherein said first baffle board is approximately circular.

12. A loudspeaker comprising:

a spherical or hemispherical vibrator;

a first baffle board having first and second major surfaces, said vibrator being mounted on the first major surface of the first baffle board so as to extend outwardly therefrom;

a second baffle board arranged so as to be spaced from the first baffle board; and a plurality of spacers for connecting the first baffle board and second baffle board; wherein the second baffle board is arranged such that the first baffle board is disposed between the vibrator and the second baffle board;

the first baffle board and the second baffle board are spaced from each other so as to define an open space between; and only the plurality of spacers extends into the open space.

13. A loudspeaker as claimed in claim 12, wherein the natural resonant frequency of the vibrator has a value that is greater than any frequency in the desired bandwidth of the loudspeaker.

14. A loudspeaker as claimed in claim 12, wherein the first and second baffle boards have natural resonant frequencies which are lower than the natural resonant frequency of the vibrator.

15. A loudspeaker as claimed in claim 12, wherein the first baffle board and second baffle board have natural resonant frequencies which are different from each other.

16. A loudspeaker as claimed in claim 15, wherein the first and second baffle boards have natural resonant frequencies which are lower than the natural resonant frequency of the vibrator.

17. A loudspeaker as claimed in claim 12, wherein the resonance frequency of the space is different from the natural resonant frequency of the vibrator, and different from the natural resonant frequencies of the baffle boards.

18. A loudspeaker as claimed in claim 12, wherein the resonance frequency of the space is lower than the natural resonant frequency of the vibrator.

19. A loudspeaker as claimed in claim 17, wherein the resonance frequency of the space is lower than the natural resonant frequency of the vibrator.

20. A loudspeaker as claimed in claim 12, wherein the resonance frequency of the space is higher than one of said first and second baffle boards, and lower than the other of said first and second baffle boards.

21. A loudspeaker as claimed in claim 17, wherein the resonance frequency of the space is higher than one of said first and second baffle boards, and lower than the other of said first and second baffle boards.

* * * * *